United States Patent [19]

Ohlsson et al.

[11] Patent Number: 4,624,643

[45] Date of Patent: Nov. 25, 1986

[54] BOAT PROPELLER DRIVE UNIT WITH TRIM/TILT SENSOR

[75] Inventors: Lars-Erik Ohlsson, Hisings Backa; Ulf Söderbaum, Skärhamn; Kjell Borgersen, Hjälteby, all of Sweden

[73] Assignee: AB Volvo Penta, Goteborg, Sweden

[21] Appl. No.: 651,846

[22] Filed: Sep. 18, 1984

[30] Foreign Application Priority Data

Sep. 19, 1983 [SE] Sweden ..... 8305027

[51] Int. Cl.[4] ..... B63H 5/12

[52] U.S. Cl. ..... 440/2

[58] Field of Search ..... 440/2, 6, 53, 57–59, 440/1; 114/144 E; 340/689, 987

[56] References Cited

U.S. PATENT DOCUMENTS

| | | | |
|---|---|---|---|
| 2,549,480 | 4/1951 | Kiekhaefer | 440/2 |
| 3,750,617 | 8/1973 | Pinkerton | 440/2 |
| 3,844,247 | 10/1974 | Collis et al. | 440/2 |
| 4,005,674 | 2/1977 | Davis | 440/2 |
| 4,364,733 | 12/1982 | Lohner | 440/2 |
| 4,493,656 | 1/1985 | Inoue et al. | 440/2 |

FOREIGN PATENT DOCUMENTS

| | | | |
|---|---|---|---|
| 427101 | 3/1983 | Sweden | 440/2 |

*Primary Examiner*—Galen L. Barefoot
*Assistant Examiner*—Stephen P. Avila
*Attorney, Agent, or Firm*—Young & Thompson

[57] ABSTRACT

A boat propeller drive unit, a so-called inboard-outboard drive unit, has a sensor which senses the trim/tilting angle of the drive unit and is designed to be connected to an electrical indicator instrument on the boat instrument panel. The sensor is a potentiometer mounted in a recess in the drive unit steering shaft. A shaft mounted in a bore in the steering shaft engages the potentiometer and is joined at its lower end to a gear, which engages a toothed segment on the helmet of the drive unit. When the drive unit is tilted, the gear is rotated by the toothed segment, and the output signal of the potentiometer varies.

7 Claims, 4 Drawing Figures

BOAT PROPELLER DRIVE UNIT WITH TRIM/TILT SENSOR

The present invention relates to a boat propeller drive unit of the type which has a portion mounted in an opening in a boat transom and designed to be drivingly connected to a motor place inside the transom and a propeller leg disposed outside the transom, said let being adjustable to various angles in relation to the transom by tilting about a horizontal axis and pivotable about a steering shaft lying in a vertical plane, said drive unit comprising means for providing to an instrument an output signal dependent on the tilting angle relative to the transom, which signal indicates said angle.

Boat propeller drive units of this type, so-called inboard-outboard drive units, can be tilted or trimmed to various angles in relation to the transom to adapt the angular setting of the drive unit to the cruising attitude of the boat in the water. These drive units can also be tilted up so that the propeller housing is raised out of the water. Certain inboard-outboard drive units are provided with an electrical sensor which is coupled to a position indicator instrument panel of the boat, whereby the trim/tilt angle can be read. In previously know designs of this type, the electrical sensor is placed at the tilt axis. This creates problems however due to the fact that the tilt axis is located outside the transom. The environment for electrical components is thus the worst imaginable placing very high demands on careful sealing of both the sensor itself and the electrical wires to the sensor which must pass through the transom.

The purpose of the present invention is to achieve a boat propeller drive unit of the type described by way of introduction, which removes the disadvantages of known trim/tilt angle sensors.

This is achieved according to the invention by virtue of the fact that said means comprise a signal emitter spaced from the tilt axis and having means extending through the steering shaft and cooperating with the position sensor, which is joined to the propeller leg and extends in a circular arc having the tilt axis as its center, in order to actuate the signal emitter to send a signal dependent on the tilting angle of the propeller leg.

The advantage of the arrangement according to the invention is that the signal emitter can be placed in a location where it is well-protected against splashing water, namely inside the shield which acts as the drive unit mounting in the transom and through which the steering shaft extends. As a result, no wires need be drawn through the transom.

Figure 1:
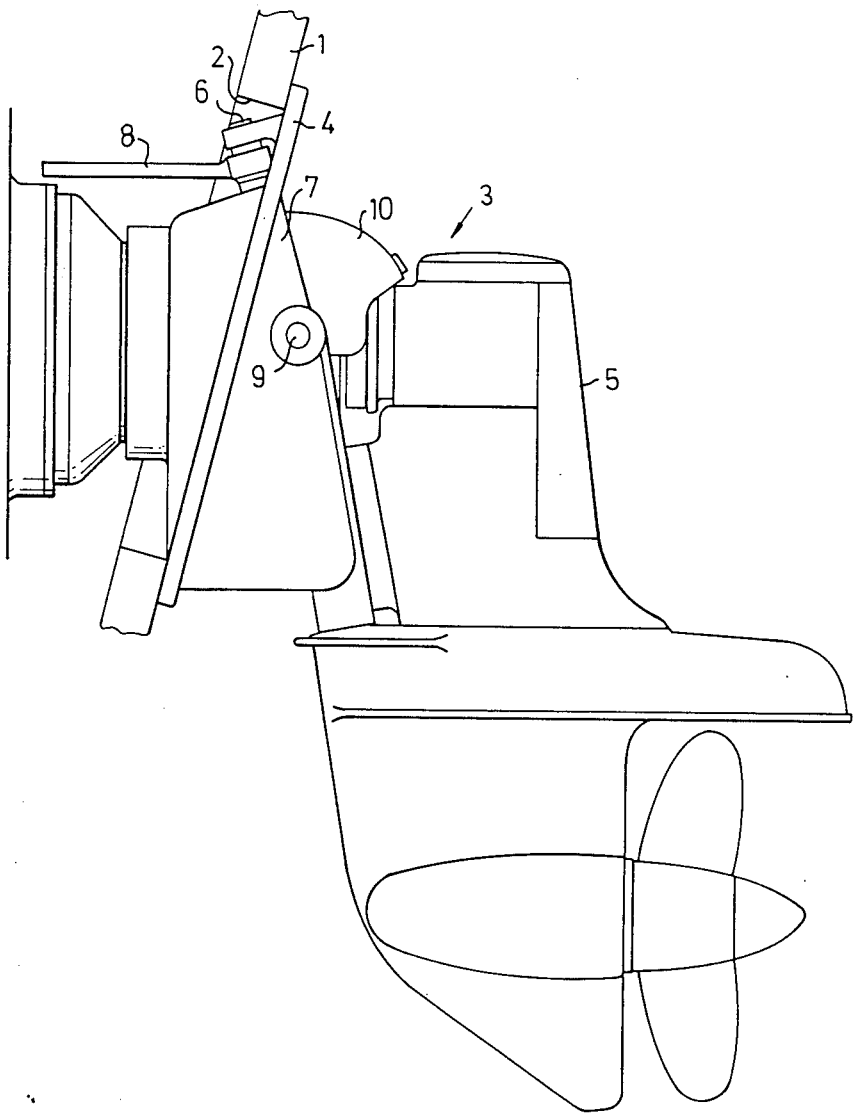
FIG.1 PRIOR ART
Figure 2:
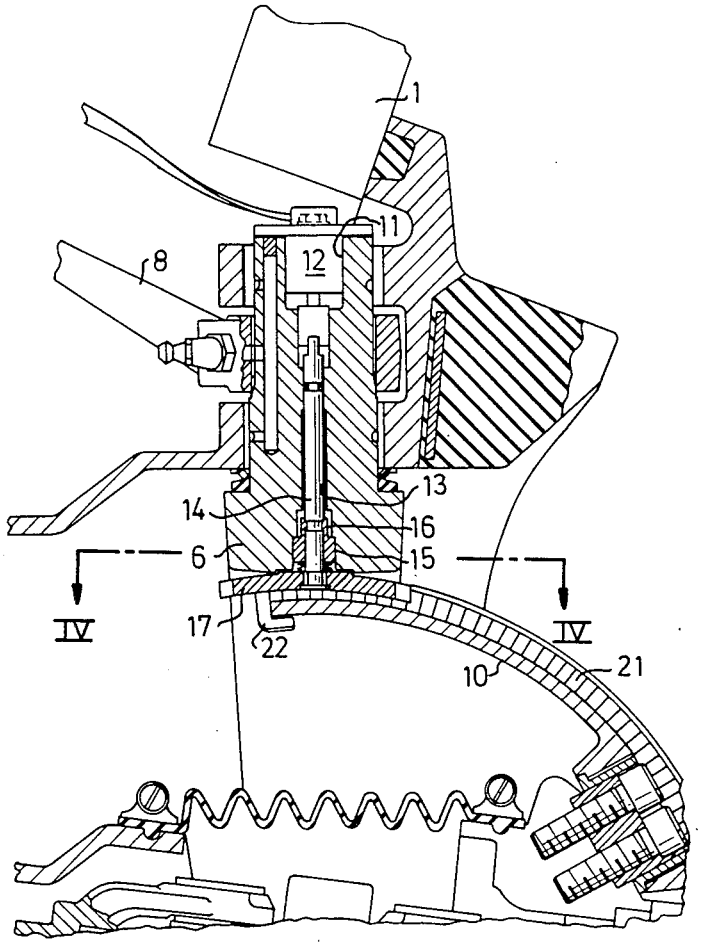
Figure 4:
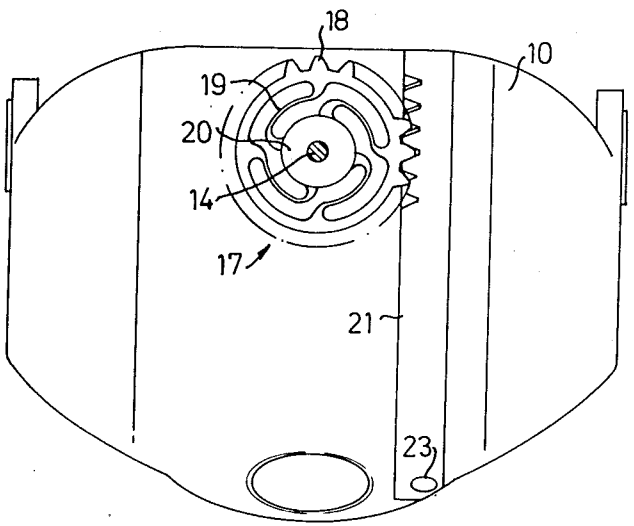
Figure 3:
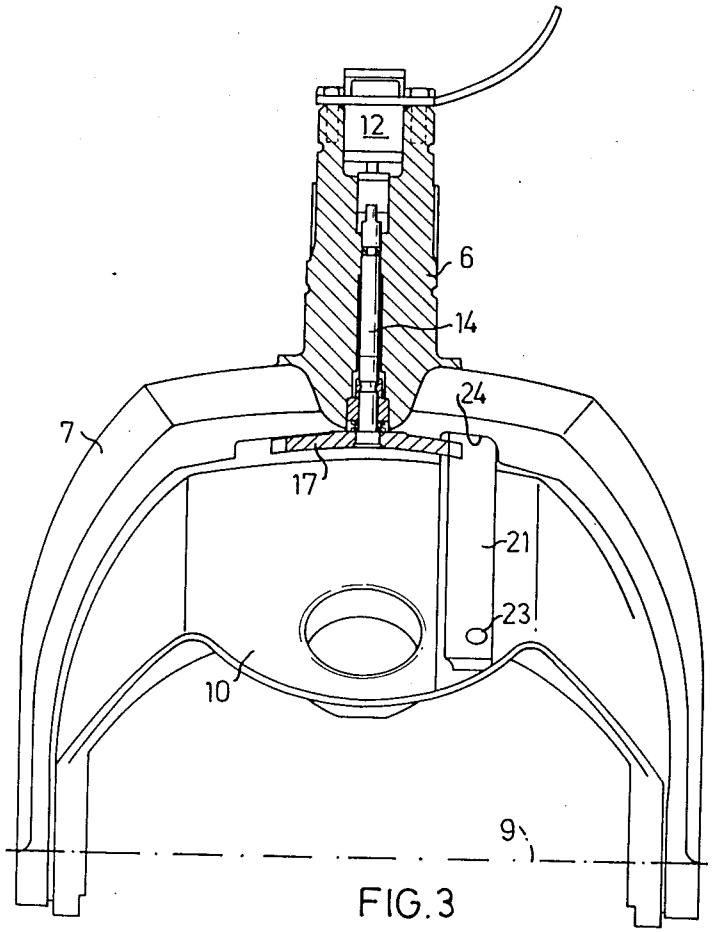

The invention will be described in more detail with reference to an example shown in the accompanying drawings, in which FIG. 1 shows a side view of a known outboard drive unit, FIG. 2 shows a longitudinal section through the steering shaft and helmet of a drive unit according to the invention, FIG. 3 shows a frontal view, partially in section, of the steering shaft and the helmet, and FIG. 4 shows a view along the line IV—IV in FIG. 2.

In FIG. 1, 1 designates the tansom of a boat with an opening 2 in which an outboard drive unit 3 is mounted in a conventional manner and which is covered on the outside by a shield 4 on the drive unit. The drive unit has a propeller leg 5 which is supported by the shield 4.

A steering shaft 6 with a fork 7 is mounted in the shield and is joined to a steering arm 8 which is to be connected to the steering controls of the boat. The tines of the fork 7 are provided at their outer ends with pins 9 on which the helmet 10 is pivotally mounted. The helmet 10 covers the drive shaft joints and is joined to the propeller leg 5 to transmit the rotation of the steering shaft to the propeller leg.

According to the invention, the steering shaft 6 is provided at its upper end with a central recess 11 in which a signal emitter 12 in the form of a rotary potentiometer is mounted (FIGS. 2 and 3). From the recess 11, a central through bore 13 extends in which a shaft 14 is rotatably mounted in a bearing 15 using a snap ring 16 which fixes the shaft axially. The shaft 14 is in engagement at its upper end with the potentiometer 12. At its lower end, the shaft supports a gear 17 which is made of plastic and is fixed to the shaft by force fitting. Thus, turning the gear 17 can vary the signal from the potentiometer.

The gear 17 has a toothed rim 18 which is joined via thin, curved spokes 19 to a hub 20 (FIG. 4). The teeth of the rim 18 engage the teeth of a toothed segment 21 which is fixed to the helmet 10 and is adapted to the shape of the helmet, i.e. to a circular arc with the tilt axis as its center. When the propeller leg is tilted, the toothed segment 21 will thus rotate the gear 17 and thus change the setting of the potentiometer. The potentiometer can be of high resistance (1 kΩ), have no mechanical stop, and have an electrical rotational angle of 320°.

The toothed segment 21 has at one end a hook 22 which grasps around one edge of the helmet. At its other end, the toothed segment has a pin 23 which is inserted into and locked in a hole in the helmet. Lateral movement of the toothed segment is controlled by a groove 24 in the fork 7. The toothed segment is disposed in relation to the gear so as to produce a certain amount of pretension in the spokes, to compensate for normal play in the system and missed margins of tolerance, and in all cases assure tooth engagement without play. In the embodiment described, the toothed segment follows the up and down movements of the helmet without play, and the lateral movements of the helmet caused by the steering forces do not affect the toothed engagement.

In the embodiment described, the ratio between the angles of the propeller leg and the potentiometer is 1:4.6, which gives the potentiometer high definition. The embodiment according to the invention provides a device which is simple to calibrate; one need only loosen the mounting of the potentiometer and turn it.

Other conceivable embodiments within the scope of the invention are also possible. For example, a cam curve on the helmet can cooperate with a rod which slides in the shaft to set a potentiometer, or an inductive sensor can cooperate with a magnetic strip on the helmet.

What we claim is:

1. In a boat propeller drive unit of the type which has a portion securely mounted in an opening in a boat transom and designed to be drivingly connected to a motor placed inside the transom, and a propeller leg disposed outside the transom, said leg being adjustable to various angles in relation to the transom by tilting about a horizontal axis and pivotable about an upright steering shaft, said drive unit comprising means for providing to an instrument an output signal dependent on the tilting angle relative to the transom, which signal indicates said angle; the improvement in which said means comprise a signal emitter spaced from the tilt axis and having means extending through the steering shaft and cooperating with a position sensor which is joined to the propeller leg and extends in a circular arc having the tilt axis as its center, in order to actuate the signal emitter to send a signal dependent on the tilting angle of the propeller leg relative to the steering shaft, the signal emitter and the position sensor having elements which cooperate mechanically with each other, the signal emitter being joined to a shaft mounted in the steering shaft, said shaft having a gear thereon, and the position sensor comprising a toothed segment which is curved in a circular arc with the tilt axis as its center.

2. Boat propeller drive unit according to claim 1, characterized in that the signal emitter is arranged concentrically to the steering shaft.

3. Boat propeller drive unit according to claim 1, characterized in that the gear and the toothed segment are in resilient engagement with each other.

4. Boat propeller drive unit according to claim 3, characterized in that the gear has a toothed rim which is joined via resilient spokes to a hub securely joined to said shaft.

5. Boat propeller drive unit according to claim 1, in which the steering shaft has a fork which grasps a helmet which is joined to the propeller leg and is pivotally mounted on pins at the ends of the fork tines, characterized in that the signal emitter is mounted in a recess in the end of the steering shaft directed away from the fork, in that the gear if arranged at the opposite end of the steering shaft between the fork tines, and that the toothed segment is fixed to the outside of the helmet.

6. Boat propeller drive unit according to claim 5, characterized in that the toothed segment is mounted for limited lateral movement relative to the helmet.

7. Boat propeller drive unit according to claim 6, characterized in that the fork has a groove which serves as a guide for the toothed segment.

* * * * *